US008230933B2

(12) United States Patent
Snider et al.

(10) Patent No.: US 8,230,933 B2
(45) Date of Patent: Jul. 31, 2012

(54) TOP DRIVE CASING SYSTEM

(75) Inventors: Randy Gene Snider, Houston, TX (US); David Othman Shahin, Houston, TX (US); John Timothy Allen, Katy, TX (US); Kevin Leon Gray, Friendswood, TX (US); Gary Thompson, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/078,743

(22) Filed: Apr. 1, 2011

(65) Prior Publication Data

US 2011/0232919 A1 Sep. 29, 2011

Related U.S. Application Data

(60) Continuation of application No. 10/350,218, filed on Jan. 23, 2003, now Pat. No. 7,918,273, which is a division of application No. 09/550,721, filed on Apr. 17, 2000, now Pat. No. 6,536,520.

(51) Int. Cl.
*E21B 19/16* (2006.01)

(52) U.S. Cl. ..... 166/379; 166/77.51; 166/380

(58) Field of Classification Search ..... 166/77.51, 166/77.52, 380, 379; 294/82.16
See application file for complete search history.

(56) References Cited

U.S. PATENT DOCUMENTS 1,601,369 A * 9/1926 Montgomery ..... 294/102.2
1,648,158 A * 11/1927 Wilson ..... 294/90
1,725,902 A * 8/1929 Driscoll ..... 294/82.16
2,354,217 A * 7/1944 Mullinix et al. ..... 294/90
3,662,842 A 5/1972 Bromell
3,747,675 A 7/1973 Brown
3,766,991 A 10/1973 Brown
3,776,320 A * 12/1973 Brown ..... 173/213
3,915,244 A 10/1975 Brown
3,964,552 A 6/1976 Slator
4,051,587 A 10/1977 Boyadjieff
4,100,968 A 7/1978 Delano
4,192,155 A 3/1980 Gray
4,235,469 A 11/1980 Denny et al.
4,762,187 A 8/1988 Haney
4,815,546 A 3/1989 Haney et al.
4,821,814 A 4/1989 Willis et al.
4,867,236 A * 9/1989 Haney et al. ..... 166/77.51
5,036,927 A 8/1991 Willis
5,297,833 A * 3/1994 Willis et al. ..... 294/102.2
5,645,131 A 7/1997 Trevisani
5,839,330 A 11/1998 Stokka
6,102,116 A 8/2000 Giovanni
6,142,545 A 11/2000 Penman et al.
6,161,617 A 12/2000 Gjedebo
6,309,002 B1 10/2001 Bouligny
6,311,792 B1 * 11/2001 Scott et al. ..... 175/162
6,431,626 B1 8/2002 Bouligny
(Continued)

*Primary Examiner* — Hoang Dang
(74) *Attorney, Agent, or Firm* — Patterson & Sheridan, LLP

(57) ABSTRACT

A torque head for gripping tubular members, in at least some aspects, has a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable.

23 Claims, 12 Drawing Sheets

U.S. PATENT DOCUMENTS 6,443,241 B1 * 9/2002 Juhasz et al. ..... 175/52
6,527,047 B1 3/2003 Pietras
6,536,520 B1 * 3/2003 Snider et al. ..... 166/78.1
6,622,796 B1 9/2003 Pietras
6,637,526 B2 10/2003 Juhasz et al.
6,679,333 B2 1/2004 York et al.
6,691,801 B2 2/2004 Juhasz et al.
6,705,405 B1 3/2004 Pietras
6,725,938 B1 4/2004 Pietras
6,732,822 B2 5/2004 Slack et al.
6,742,584 B1 6/2004 Appleton
6,976,298 B1 12/2005 Pietras
7,699,121 B2 4/2010 Juhasz et al.
7,918,273 B2 * 4/2011 Snider et al. ..... 166/237

* cited by examiner

TOP DRIVE CASING SYSTEM

CROSS-REFERENCE TO RELATED APPLICATIONS

This application is a continuation of U.S. patent application Ser. No. 10/350,218, filed Jan. 23, 2003, now U.S. Pat. No. 7,918,273 which is a divisional of U.S. patent application Ser. No. 09/550,721, filed Apr. 17, 2000, now U.S. Pat. No. 6,536,520, and each of the aforementioned related patent applications are herein incorporated by reference in their entirety.

BACKGROUND OF THE INVENTION

1. Field of the Invention

The present invention is directed to wellbore operations, top drives, top drive casing systems and operations, torque heads, top drives with torque heads, and methods using them.

2. Description of the Related Art

The prior art discloses many systems and methods for running casing. The prior art also discloses a variety of systems using a top drive for running casing. Certain prior art top drive systems include the attachment of a spider (e.g. but not limited to, a flush mounted spider) suspended beneath a top drive from the bails.

The bails are then rigidly fastened to a top drive quill so as to cause the flush mounted spider to rotate in unison with any rotation of the quill. Engagement of the flush mounted spider's slips with a casing joint or string causes the casing to rotate in coordinated unison with the spider. FIG. 17 shows a prior art top drive in which the collective assembly beneath a bull gear is able to rotate and is collectively referred to as the "pipe handling" or "handler" system. This pipe handling system can be made to slue in coordination with the quill by rigidly affixing the bails to the quill. In certain embodiments of such a system since the top drive's pipe handling system rotates with the tool at all times, rotation is limited to the design speed limit of the system's seals and bearings—about 6 rpm in some cases. This can add many hours to a casing job. The present inventors have recognized that a system is needed that can rotate significantly faster during the spin-in phase of makeup, like a tong and which would only engage a pipe handler to turn the tool after makeup if there is a stuck pipe situation. Another disadvantage with such systems is that by making the torque head the primary hoisting device the cost of the device is increased and also, in many cases, makes it necessary to produce or own different size/tonnage range torque head assemblies to cover both different size ranges—and within size ranges, different tonnages. The present inventors have recognized a need for a system that allows a rig to utilize hoisting equipment it already owns for primary hoisting and a system with a torque head that is lighter, i.e. a less expensive device capable of use universally within a size range regardless of tonnage requirements.

With many known prior art devices, apparatuses and systems 10 with which casing is gripped, e.g. by jaws, inserts, or dies, the casing is damaged. Such damage can result in casing which cannot be used. When premium tubulars are required, such damage is very expensive.

There has long been a need for an efficient and effective 15 system and method for running casing (making-up and breaking-out connections) with a top drive. There has long been a need for such a system and method which provides for continuous fluid circulation during running operations. There has long been a need for such a system and method that efficiently and effectively rotates casing and applies downward force on a casing string while the string is being installed in a wellbore. There has long been a need for such systems and methods which reduce damage to casing. There has long been a need for such a system and method wherein an apparatus that grips casing does not become locked on the casing.

SUMMARY OF THE INVENTION

The present invention, in certain aspects, provides a system with a top drive and its related apparatus, and a torque head connected to and below the top drive in a rig for selectively gripping casing. The present invention, in certain embodiments, discloses a torque head useful in such systems and methods, the torque head with jaws with grip members, including but not limited to, slips, dies, and inserts; and in one particular aspect slips with movable dies or inserts that have some degree of axial freedom with respect to the jaws so that, in one aspect, when the slips first contact the exterior of a casing section the dies or inserts move axially with respect to the casing rather than radially, i.e. initially they do not bite, or bite only minimally, into the casing. Then, as the casing is moved by the top drive slips allow limited vertical movement both upward and downward. This allows the slips, dies or inserts to move upward relative to the slips as they engage the casing and to move downward relative to the slips as they are disengaged from the casing.

In certain embodiments a fluid circulation tool or apparatus is mounted in a torque head according to the present invention. Part of this tool is introduced into the top of a casing joint when the joint is being hoisted and readied for makeup to a casing string. With appropriate sealing packers, the joint is filled with circulation fluid and then moved into position above the casing string. Once makeup commences, circulating fluid is circulated through the joint and to the casing string.

In certain particular embodiments of the present invention relative axial movement of the torque head with respect to a casing joint being gripped by the slips is also made possible by providing a mounting plate assembly that includes bolts holding it together and springs that allow some controlled axial movement of the torque head. With the slips gripping the casing, a torque head barrel is rigidly fixed relative to the casing and if the casing is made up to the string or is gripped at the spider, downward force on the torque head assembly causes the springs located in the top plate to compress and allows for limited axial movement relative to the casing and elevator, provided the elevator slips are engaged on the casing. Such a torque head can be used with the previously mentioned movable dies, etc., (which engage the casing when they are moved axially downwardly relative to the inner diameter of the torque head) and which are disengaged by axial movement upwardly relative to an inner diameter of the torque head. In the event the torque head assembly is subjected to a dangerous axial load of predetermined amount (e.g., but not limited to, about 100 tons or more), the bolts fail before significant damage is done to the torque head. When the bolts fail, the top plate assembly separates from the torque head barrel while the slips of the torque head assembly remain engaged against the casing, thus causing the barrel and slip mechanism within the barrel to remain firmly attached to the casing and prevent it from free falling to the rig floor. This also reduces the possibility of items falling down (e.g. the torque head) and injuring personnel.

In certain aspects, selectively controlled piston/cylinder devices are used to move the slips into and out of engagement with a casing joint. In certain embodiments the piston/cylinder assemblies have internal flow control valves and accumulators so that once the slips engage the casing, hydraulic pressure is maintained in the cylinders and the slips remain in engagement with the casing.

Methods according to the present invention with systems 20 according to the present invention are more automated than previous systems because in various prior art systems the torque head can become locked onto the casing when the slips of an elevator (or other suspension/clamping device) are engaged against the casing after the slips of the torque head have been engaged. This condition is a result of the actuation of hydraulic cylinders and then not being able to provide sufficient force to disengage the slips and overcome the mechanical advantage created by the wedging action of slip assemblies without some relative vertical movement of the casing. With the slips of the elevator set, this relative vertical movement of the casing is prevented. The same condition exists for the slips of the elevator in various prior art systems so that the torque head and elevator are locked onto the casing. Various methods are employed to prevent or preclude the torque head from becoming locked onto the casing. In one aspect the dies are capable of some vertical movement relative to the slips. In another aspect in the torque head barrel some limited vertical movement relative to the casing is allowed due to the two-piece construction of the torque head barrel top assembly with incorporated spring washers. When the need to use a power tong to makeup a casing string is eliminated, as with systems according to the present invention, the need for a tong running crew is also eliminated.

It is, therefore, an object of at least certain preferred 10 embodiments of the present invention to provide: New, useful, unique, efficient, and novel and nonobvious system and methods for running casing with a top drive;

Such systems and methods which provide automated operations;

Such systems and methods which provide continuous fluid circulation during operations;

Such systems and methods which reduce or eliminate damage to casing by using grippers with movable dies or inserts (marking or non-marking); that prevent a torquing apparatus from becoming locked onto casing and/or which reduce or eliminate axial loading on a torquing apparatus and/or by providing for shear release of the torque head from an item, e.g. a top drive connected to it.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE PREFERRED EMBODIMENT

Figure 1:
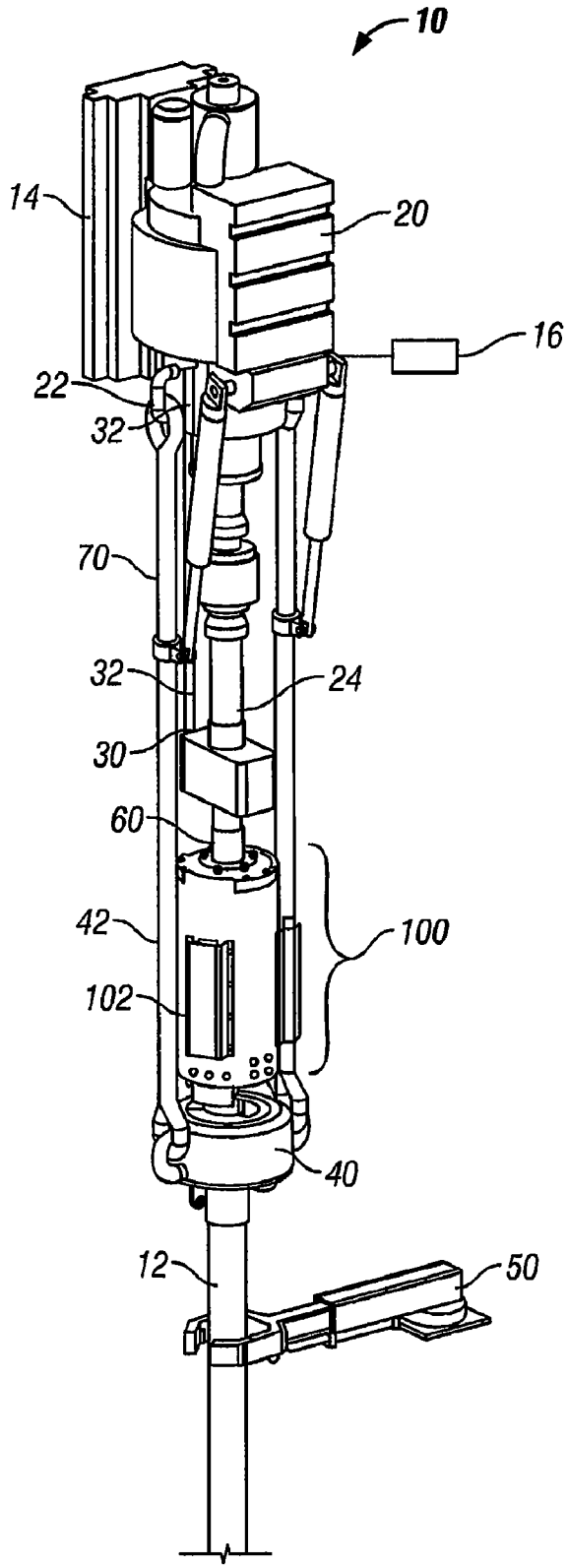
FIG. 1 is a perspective view of a system according to the present invention.
Figure 2:
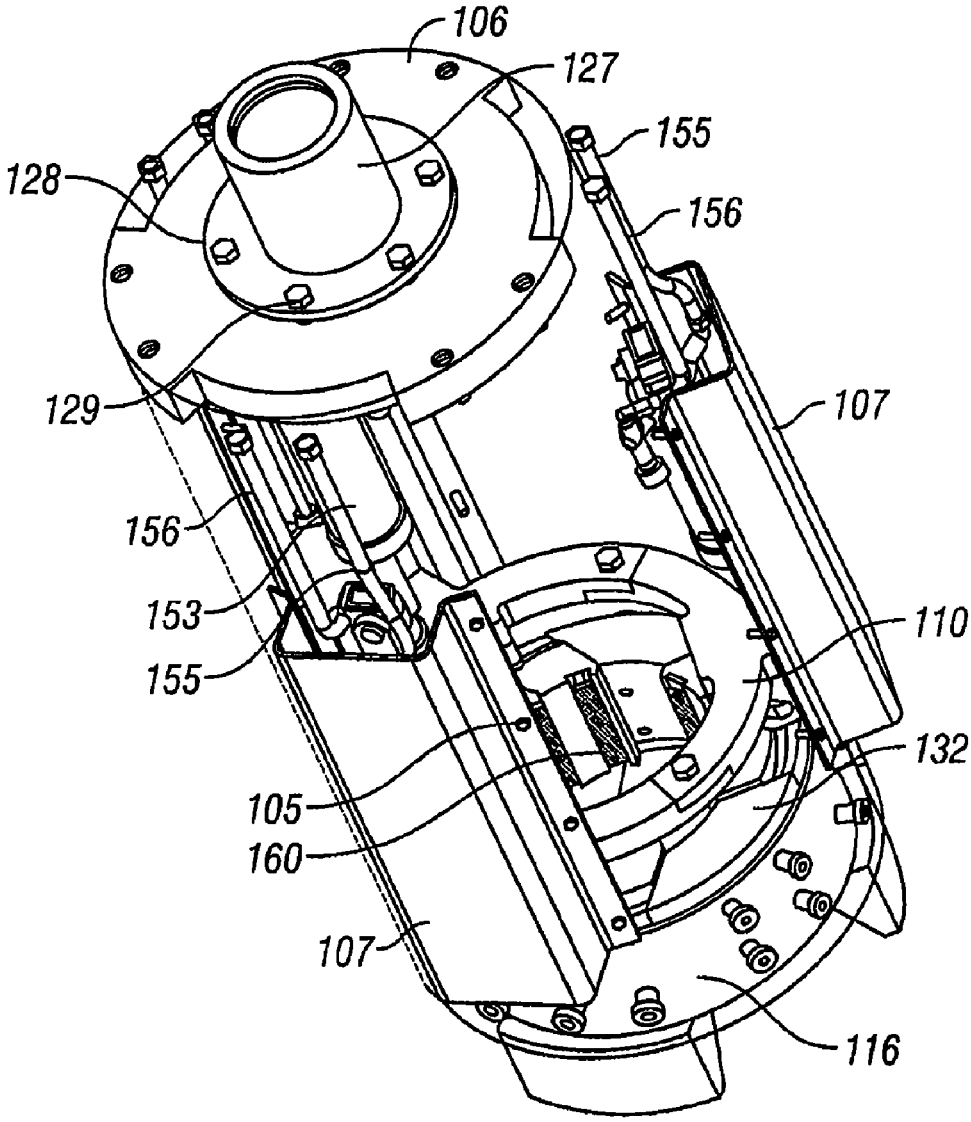
FIG. 2 is a perspective view of a part of a torque head according to the present invention.

Referring now to FIG. 1, a system 10 according to the present invention includes a top drive 20, a torque wrench assembly 30 used for back-up, an elevator 40 (which may also be any suitable known suspendable selective clamping apparatus or device), a pipe handler 50, and a torque head 100. The elevator 40 is suspended by bails 42 from eyes 22 of the top drive 20. The torque wrench assembly 30 is suspended by a support 32 from the top drive 20.

A torque sub 60 interconnects a spindle 24 (also called a "quill") of the top drive 20 and the top of a joint of casing 12 that extends into the torque head 100. Rotation of the spindle 24 by the top drive 20 rotates the torque sub 60 and the casing joint 12. A top portion of the casing 12 (or of a casing coupling if one is used) extends into the torque head 100.

A selectively operable bail movement apparatus 70 (also called a "pipe handler") moves the bails 42 and elevator 40 as desired. The top drive 20 is movably mounted to part 14 of a rig (not shown). The top drive, top drive controls, torque wrench assembly, torque sub, elevator, bail movement apparatus and pipe handler may be any suitable known apparatuses as have been used, are used, and/or are commercially available.

Preferably the torque head is positioned above the elevator and the torque head is connected to the top drive spindle. In one particular embodiment the spindle or "quill" projects down into a top barrel of the torque head about 5.625 inches. The spindle is threadedly connected to the top of the torque head.

By controlling and selectively rotating the spindle 24 with the top drive 20, hoisting, lowering and torquing of casing is controlled via controls 16 (shown schematically) of the top drive 20. The torque sub 60 is interconnected with and in communication with controls 16 and it monitors torque applied to casing, e.g. during a makeup operation.

With the spindle or quill 24 engaged by the back-up assembly 30, the bails 42, elevator 40, and torque head 100 rotate together, thereby rotating a casing string (not shown) whose top joint is engaged by the torque head 100 while the string is lowered or raised. This is advantageous in the event the casing becomes stuck during setting operations; it is desirable to be able to rotate the casing string while it is being lowered.

Figure 7:
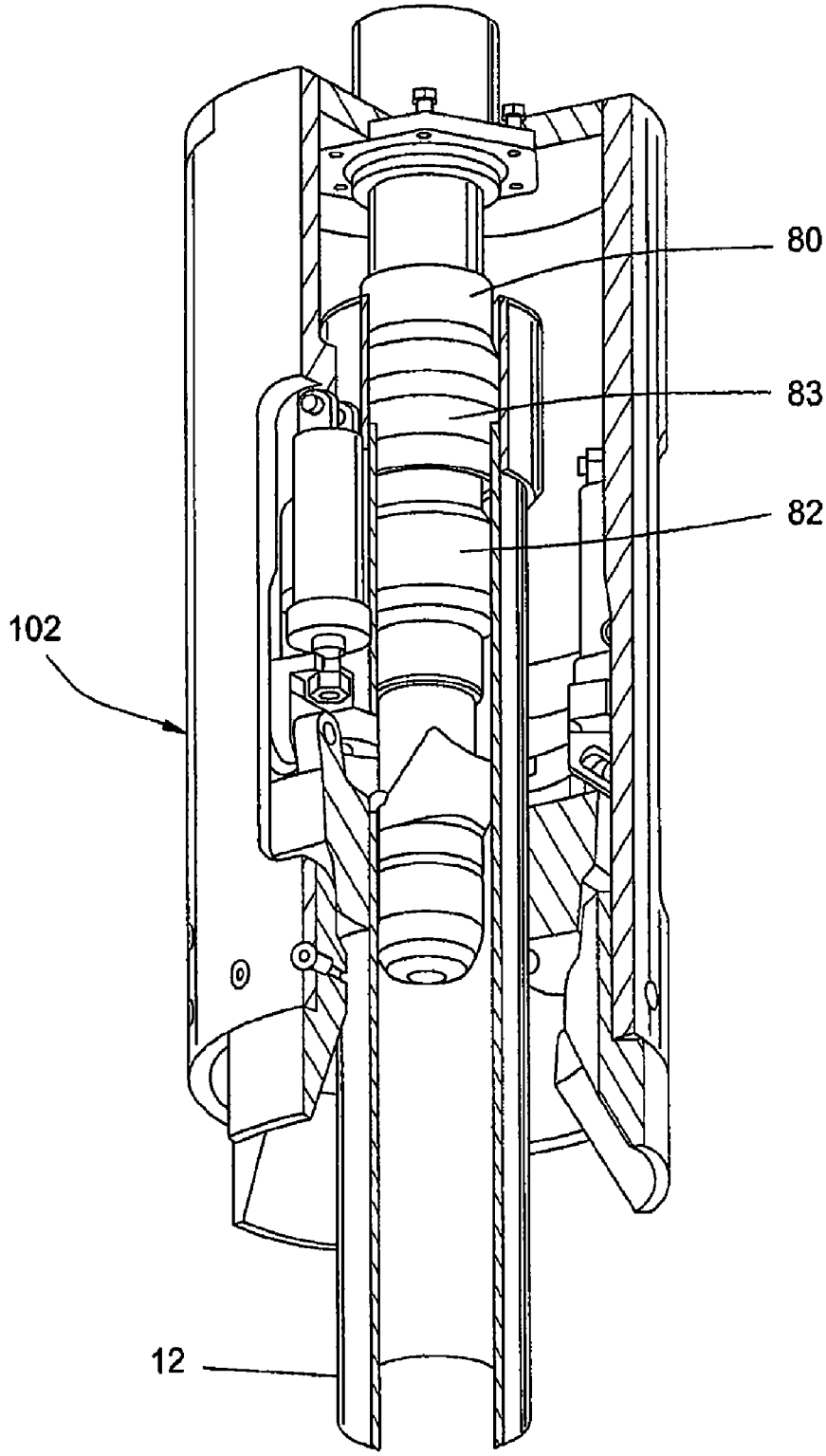
FIG. 7 is a perspective view of the torque head of FIG. 2 with 5 a circulation apparatus therein.

As shown in FIG. 7 a commercially available fillip-circulating 25 tool 80 (e.g. but not limited to a LaFleur Petroleum Services Auto Seal Circulating tool) within the torque head 100 has an end 81 inserted into the casing joint 12 when the joint 12 is being hoisted by the rig drawworks and readied for makeup to a casing string extending from the rig down into an earth wellbore. A lower packer element 82 of the tool 80 seals against the interior of the joint 12 so the joint can be filled with circulation fluid or mud. By moving the tool 80 further down within the joint 12 and sealing off the casing's interior with an upper packer element 83, circulation of drilling fluid is effected through the torque head, through the casing, and to the casing string.

As shown in FIGS. 2-7, the torque head 100 has an outer housing or barrel 102 with upper recesses 104 corresponding to projections 106 of a top plate 108. Bolts 109 bolt the top plate 108 to the housing 102. A leveling bar 110 with three sub-parts 111, 112, 113 bolted together by bolts 114 is threadedly secured to piston/cylinder apparatuses described below by pins or bolts, and the piston/cylinder apparatuses are connected to the housing 102 described below (via mounting clips). Lower sleeve portions 121, 122, 123 secured by bolts 115 to a ring 116 are spaced apart by three jaw guides 131, 132, 133 which are secured to the ring 116 (FIG. 2) by bolts 117. Jaws 141, 142, 143 each have a top member 144 positioned between ears 119 of the bar 110, each with a shaft 145 that moves in a corresponding slot 118 in the leveling bar 110 as they are raised and lowered by pistons 154 of piston/cylinder apparatuses 151, 152, 153. Lower ends of the pistons 154 are threaded for connection to part of the bar 110. Slips 160 are secured to the jaws. The controls 16 and fluid power system associated therewith or any typical rig fluid power system may be used to selectively actuate and deactivate the piston/cylinder apparatuses.

Shields 107 are bolted with bolts 105 to the housing 102. Each piston/cylinder apparatus 151, 152, 153 has flow lines 155, 156 in fluid communication with it for the selective provision of power fluid to the piston/cylinder apparatus. With a pin 157, each piston/cylinder apparatus 151-153 is connected to the housing 102, e.g. by clips.

Figure 4:
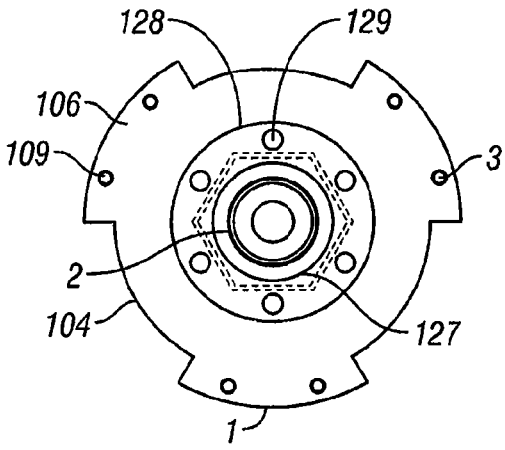
FIG. 4 is a top view of parts of the torque head of FIG. 2.
Figure 6:
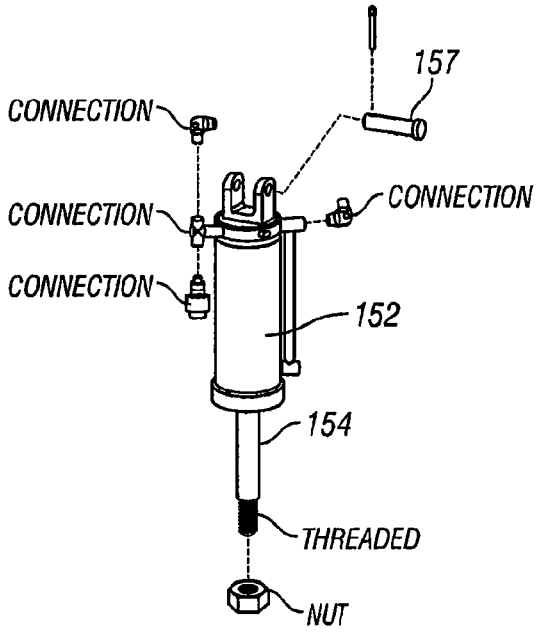
FIG. 6 is an enlarged view of a piston/cylinder device of the torque head of FIG. 2.
Figure 5:
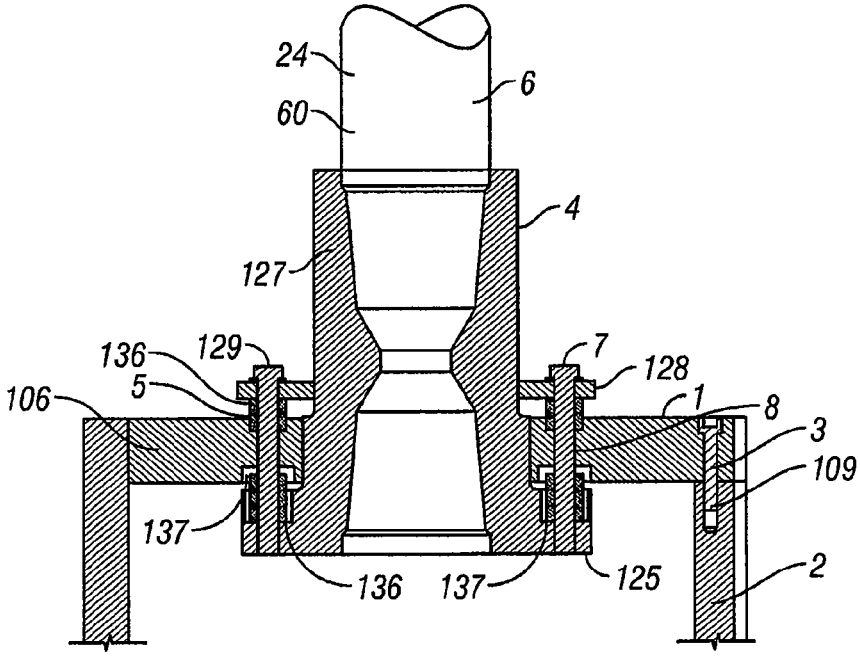
FIG. 5 is a side cross-section view of part of the torque head of FIG. 2.

The hollow top barrel 127 with a flange 128 is bolted to the top plate 106 by bolts 129. Optionally, the top barrel 127 may be mounted to the housing 102 as shown in FIGS. 4 and 5 with bolts 129 extending through the flange 128 with suitable washers or springs 136, e.g. but not limited to belleville springs, around each bolt. Each bolt 109 extends down into a lower flange 125 of the top barrel 127. Of course it is within the scope of this invention to have the top barrel 127 yieldably and movably mounted to the top plate 106 with any suitable fasteners (screws, bolts, rivets, or studs and to use any suitable spring(s) or spring apparatus(es) between the top barrel 127 and plate 106 to provide a desired degree of axial movement between these two items. This in turn permits controlled relative axial movement of the torque head relative to the casing due to the movement of the dies with respect to the slips 160. Some of the belleville springs 136 are in recesses 137 in the plate 106.

Figure 3:
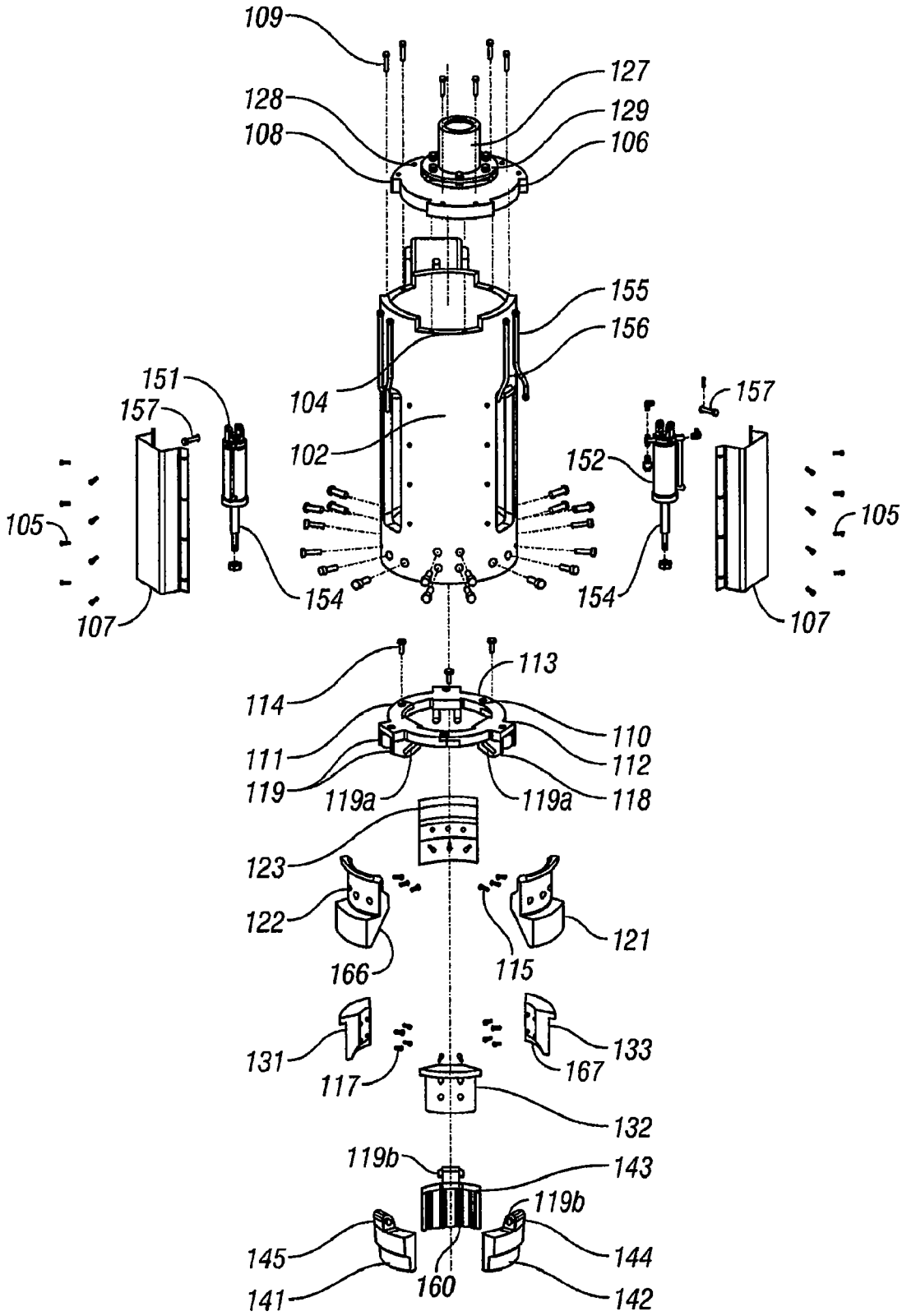
FIG. 3 is an exploded view of the torque head of FIG. 2.

As shown in FIG. 3, the lower sleeves each has an inclined portion 166 that facilitates entry of a top of a casing joint into the torque head 100. Each jaw guide also has an inclined portion 167 that facilitates entry of a top of a casing joint into the torque head 100. Each lower sleeve 121-123 is positioned behind one of the pairs of ears 119 of the leveling bar 110 and serves as a back up or stop for each jaw. Cam followers **119*b* are attached to the slips and mounted in oblique slots 119*a*** on the leveling bar free oblique motion of the slips relative to the sleeves.

Lines 155, 156 in fluid communication with a system (not shown) for selectively providing fluid under pressure, e.g. a typical rig fluid pressure system. The lines connect the hydraulic actuating cylinders to a hydraulic rotating swivel union 206 (see FIG. 11) which allows hydraulic fluid to be distributed to the cylinders as they rotate with the top drive spindle or quill. The rotating swivel union 206 permits the cylinders to rotate without twisting the hydraulic lines. The cylinders are controlled by a remotely located selector valve (item 222, FIG. 11).

Figure 11:
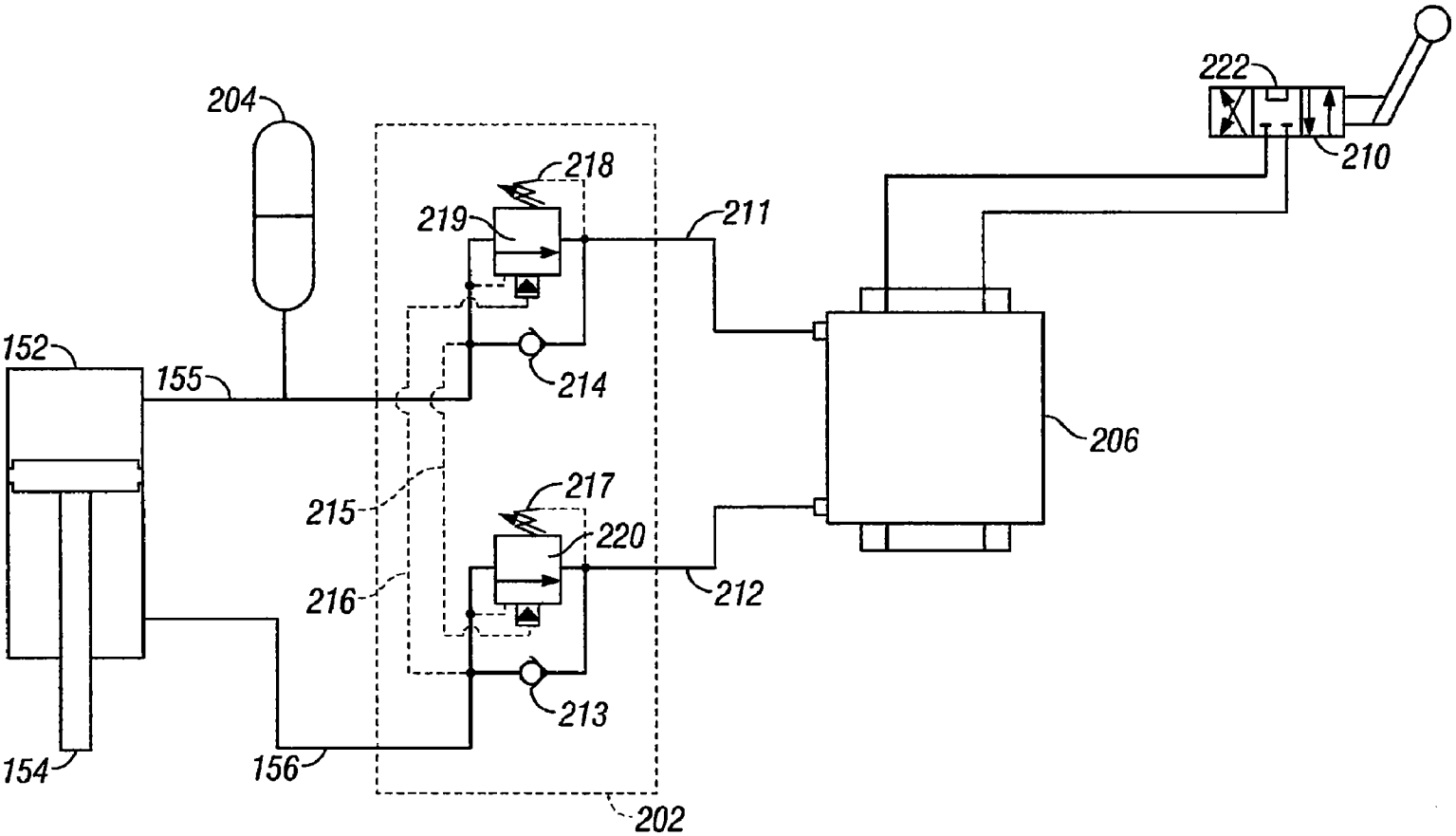
FIG. 11 is a schematic view of a hydraulic circuit useful 10 with a torque head and system according to the present invention.

FIG. 11 shows a fluid control circuit 200 according to the present invention for each piston/cylinder apparatus 151-153. A pair of pilot operated check valves 218, 220 sense a pilot pressure via lines 215 and 216. If the pressure goes below a preset amount, the valves close off lines 155, 156 thereby holding the hydraulic fluid under pressure therein and preventing the pistons 154 from moving. Thus the jaws 141-143 are held in engagement against a casing with a portion in the torque head 100. An accumulator 204 maintains fluid under pressure to provide makeup hydraulic fluid and maintain pressure on the cylinders (e.g. if fluid is lost due to seal damage leakage). Flow to and from the rotary at this swivel union 206, valve 202, accumulator 204, and piston/cylinder apparatuses 151-153 is controlled by a typical multi-position valve (e.g. but not limited to, a three position, two way, open center valve) and control apparatus 210 which can be manually or automatically activated.

Figure 10:
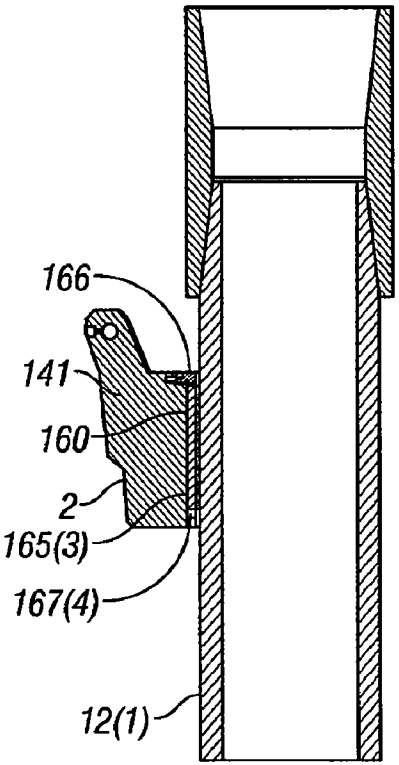
FIGS. 8, 9 and 10 are side views in cross-section showing operation of a slip according to the present invention.
Figure 9:
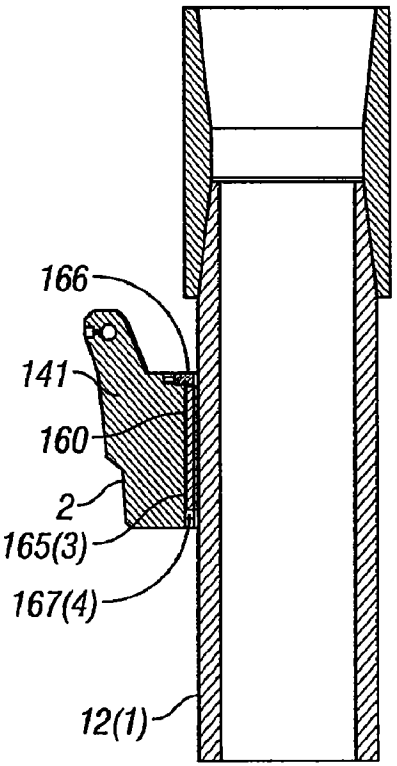
Figure 8A:
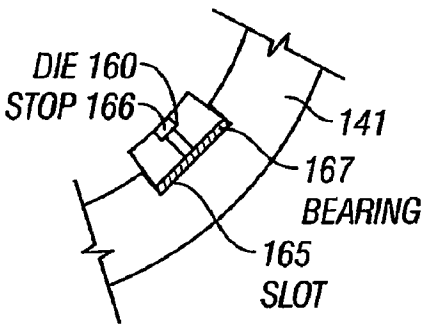
FIG. 8A is a cross-section view of part of FIG. 8.
Figure 8:
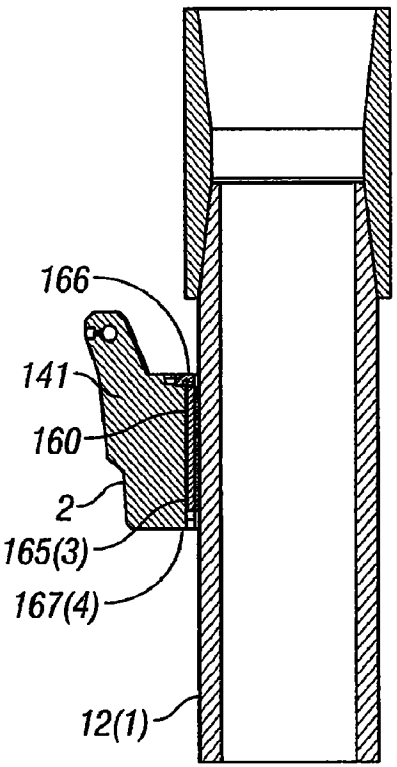

FIGS. 8-10 illustrate movement of the slips 160 with respect to the jaws 141-143 (and thus the possible relative movement of a tubular such as casing relative to the torque head). The controlled movement of these slips 160 permits controlled axial movement between the jaws and casing engaged thereby. The slips are engaged and disengaged by means of the hydraulic actuating cylinders. However, some relative vertical movement of the dies with respect to the slips may occur with vertical movement of the top drive, but this is limited by stops 166 at the top and bottom of the die grooves in the slips. Optionally, a member or bearing insert 167 made of material with a low coefficient of friction, (e.g. but not limited to, thermoplastic material, or carbon fiber, reinforced resin compound material) is positioned between the inner jaw surface and the outer slip or die surface. In one particular aspect these inserts are about one-eighth inch thick. Each slip 160 can move in a groove 165 in the jaws. Removable bolts or screws 166 prevent the slips 160 from escaping from the grooves 165. As shown in FIG. 8, the slip 160 is near yet not engaging an exterior surface of the casing 12. The slip 160 is at the bottom of its groove 165. As shown in FIG. 9, the slip 160 has made initial contact between the slip 160 and casing 12 (the jaw 141 has moved down and radially inwardly). The slip 160 is still at the bottom of the groove 165 and the member 167 provides a bias so that the slip 160 remains fixed in position relative to the casing 12 and jaw 141 and the jaw 141 continues to move down. In certain preferred embodiments, the teeth of the die insure that the frictional forces between the die and casing is significantly higher than the frictional force between the die and slip (due to the material of lower friction coefficient) so that the die is biased to move upward relative to the slip and not the casing as the slip is engaged and is biased to move downward relative to the slip as the slip is moved upward or retracted.

As shown in FIG. 10 the jaw 141 and slip 160 have engaged the 10 casing 12, the jaw 141 has moved further downwardly, and the slip 160 has moved to the top of the groove 165. Such a position of 14, the slip 160, and jaw 141 (and a similar position of the other slips and jaws) prevents lockup or allows recovery from it.

FIGS. 12-16 show steps in a method according to the present invention using a system according to the present invention as described herein, e.g. but not limited to a system as shown in FIGS. 1-11. It is to be understood that in these figures the top drive system is mounted to a typical rig or derrick (not shown).

Figure 12:
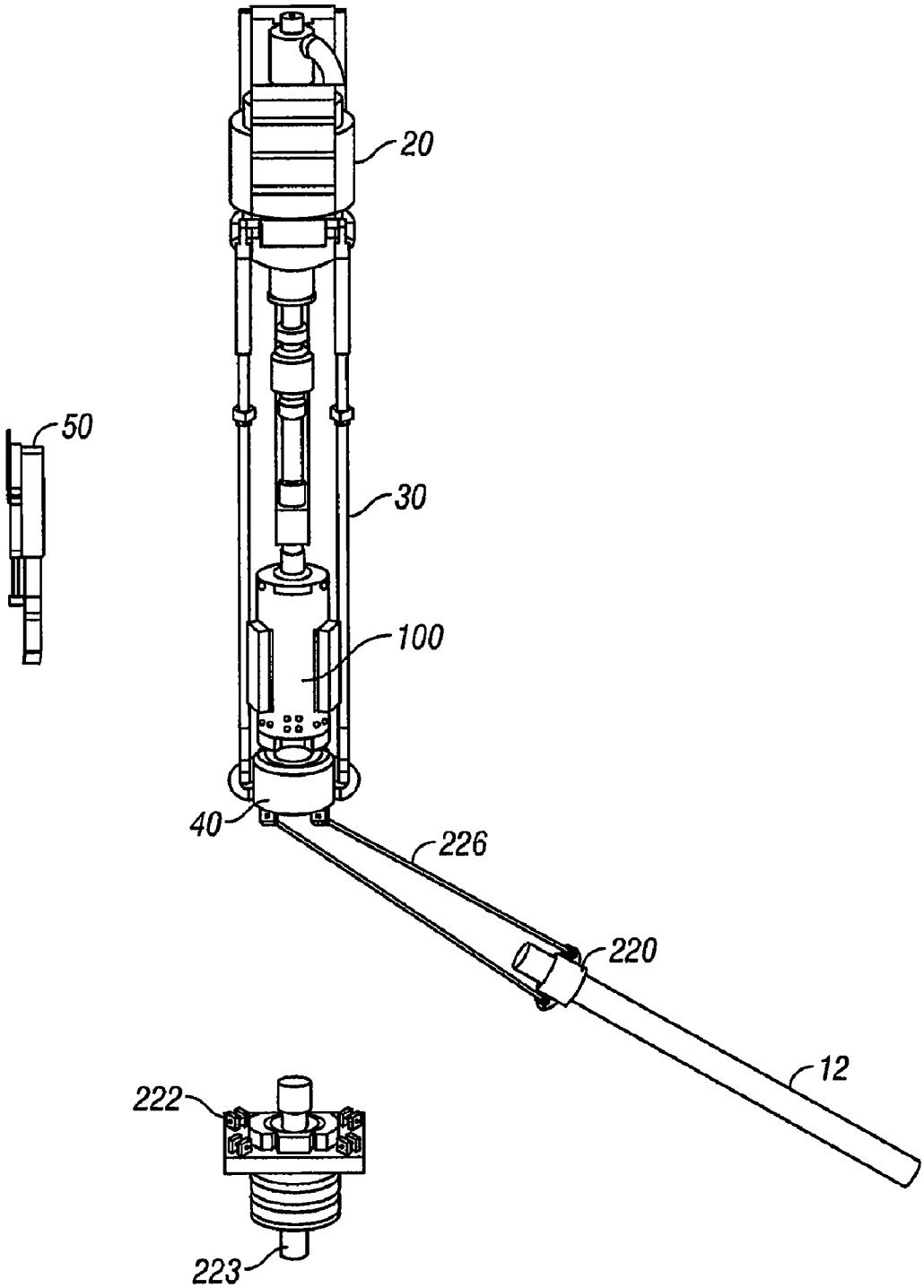
FIGS. 12-16 are side views of steps in a method using a system according to the present invention.

As shown in FIG. 12, a single joint elevator 220 has been secured around a casing joint 12 which is to be added to a casing string 223 that extends down into a wellbore W in the earth. A spider 222 (e.g. but not limited to a flush mounted spider) engages and holds a top part of a top casing joint of the string 223. It is within the scope of this invention to employ any suitable spider and single joint elevator. (Instead of the spider 222 any suitable known clamping or gripping apparatus or device may be used according to the present invention.) Also, optionally, a joint compensator 224 may be used positioned as desired, e.g. but not limited to between the torque head and the top drive. The pipe handler 50 has been lowered.

Figure 13:
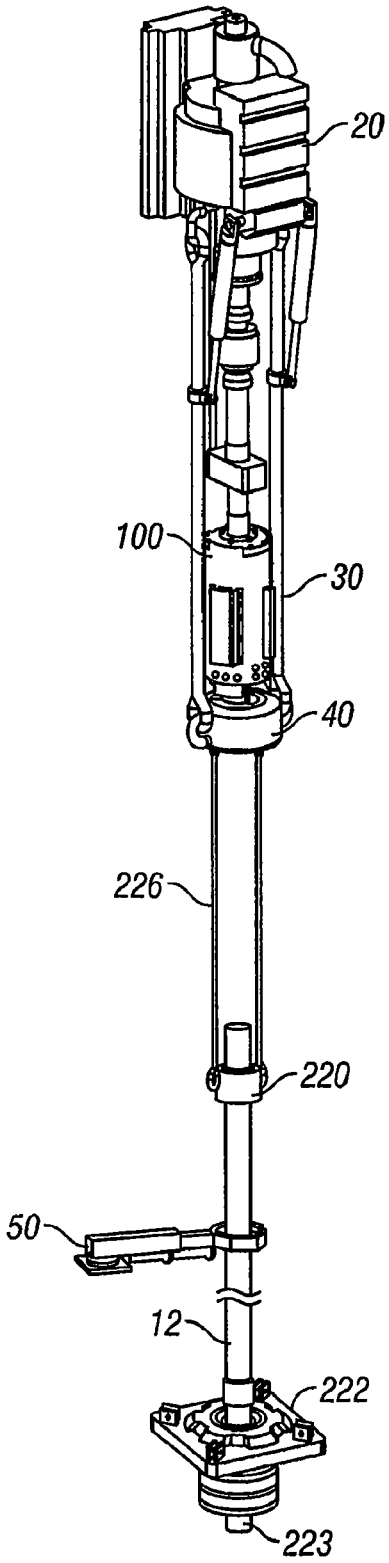
Figure 14:
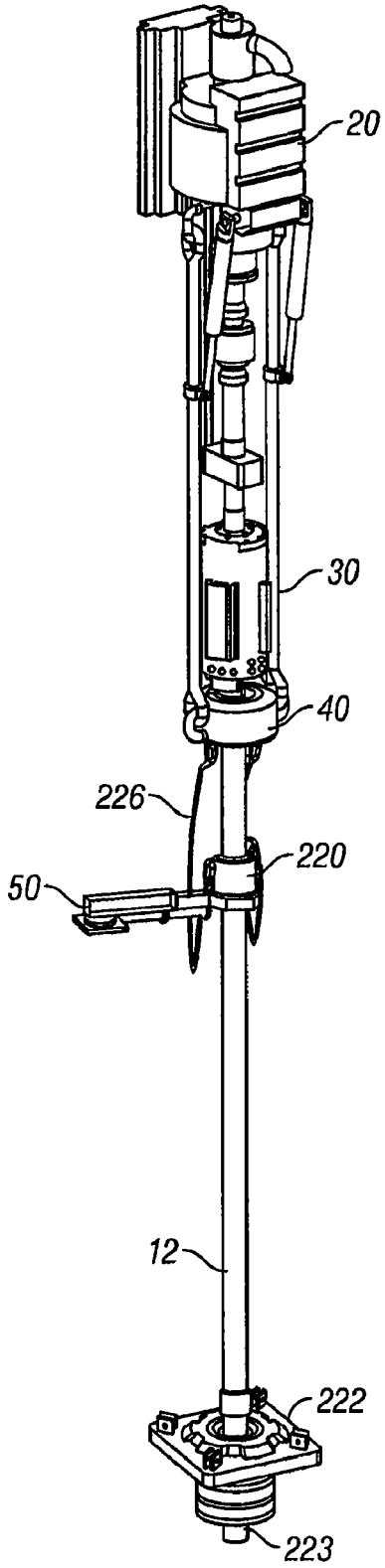

As shown in FIG. 13, the top drive 20 has been raised by the drawworks D (shown schematically) in a derrick of a rig (not shown) and the lower end of the casing 12 has been positioned above the string 223. In FIG. 14, the torque head 100 has been lowered (by lowering the top drive 20 with the drawworks D) by lowering the top drive 20 so that the elevator 40 encompasses the casing 12 and the jaws of the torque head encompass a top portion of the casing 12. The pipe handler 50 has been raised to engage the casing 12 below the elevator 220 to facilitate correct positioning of the casing 12 with respect to the top of the string 223.

Figure 15:
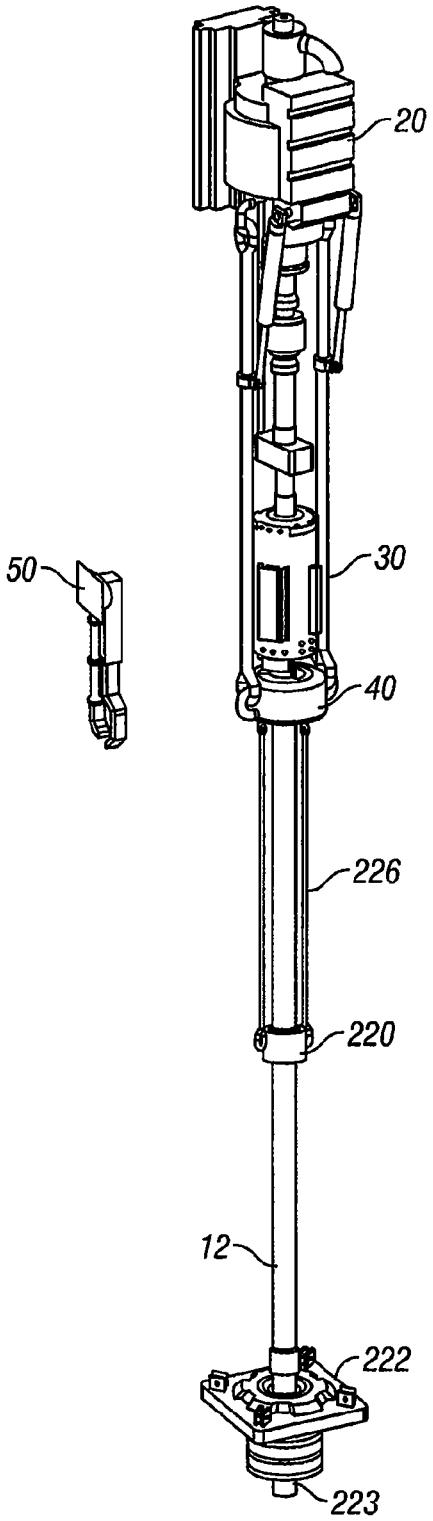
Figure 16:
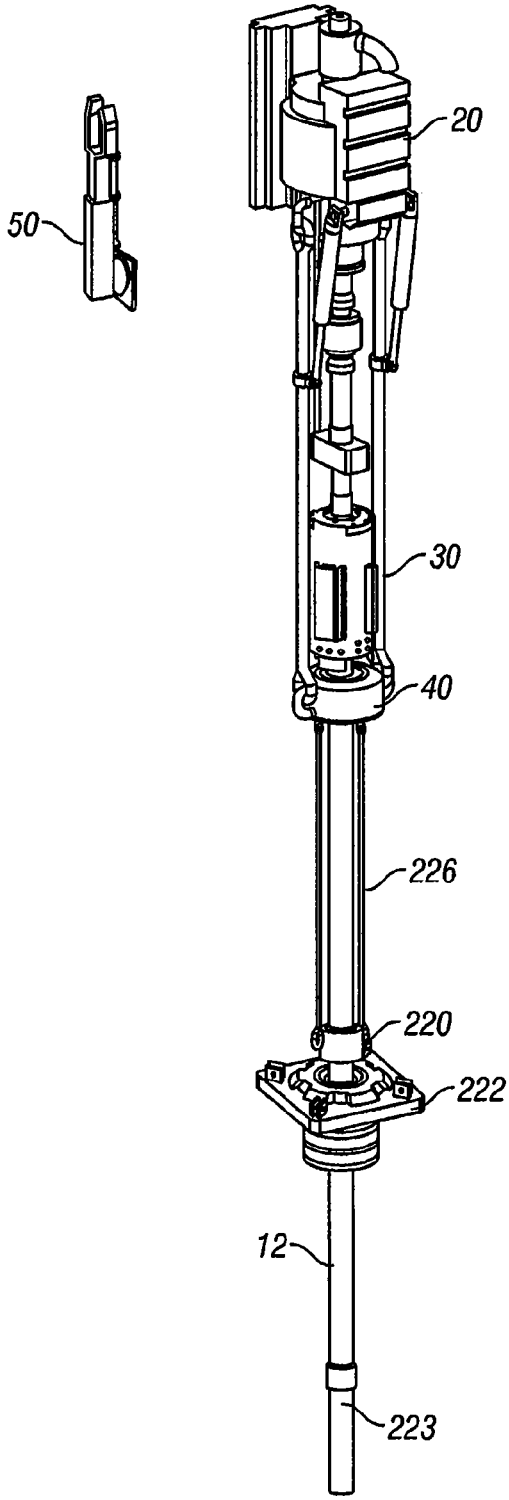
Figure 17:
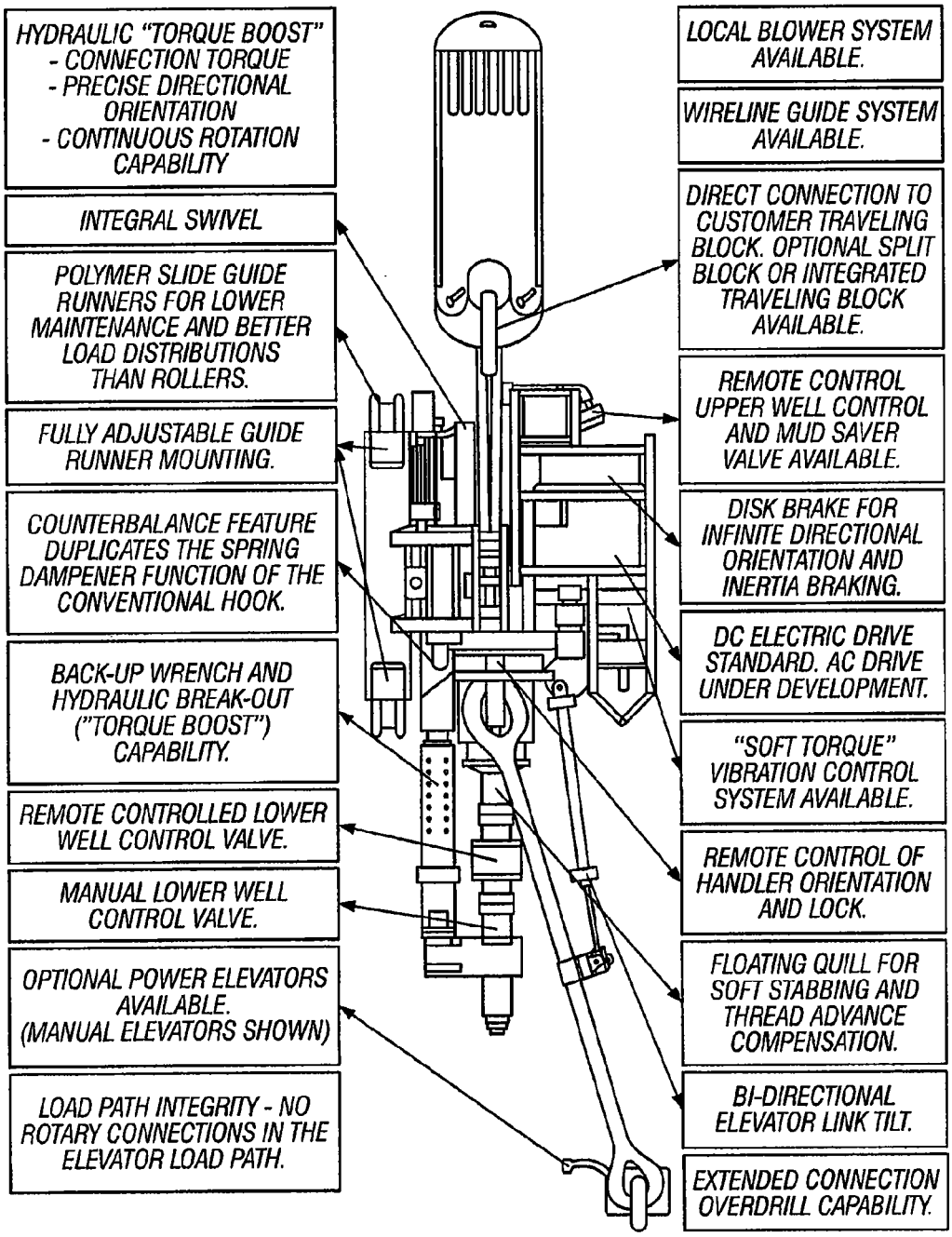
FIG. 17 is a side view of a prior art top drive system.

As shown in FIG. 15 the jaws of the torque head 100 have engaged the casing 12 to rotate it and the pipe handler 50 has been retracted and lowered out of the way. The top drive 20 has begun to slowly rotate the torque head 100 and, thus, the casing 12 to find the threads in the top joint of the string 223 and then, increasing the rate of rotation, to makeup the new connection. Then (see FIG. 16) the torque head jaws are released, the elevator 40 is activated to engage the casing and slips in the elevator move down to engage the casing; the spider 222 is released, and the top drive 20 is lowered with the drawworks D to lower the entire string 223. Then the spider 222 is reset to engage the casing 12 and the procedure begun in FIG. 12 is repeated to add another joint to the string.

Figure 18:
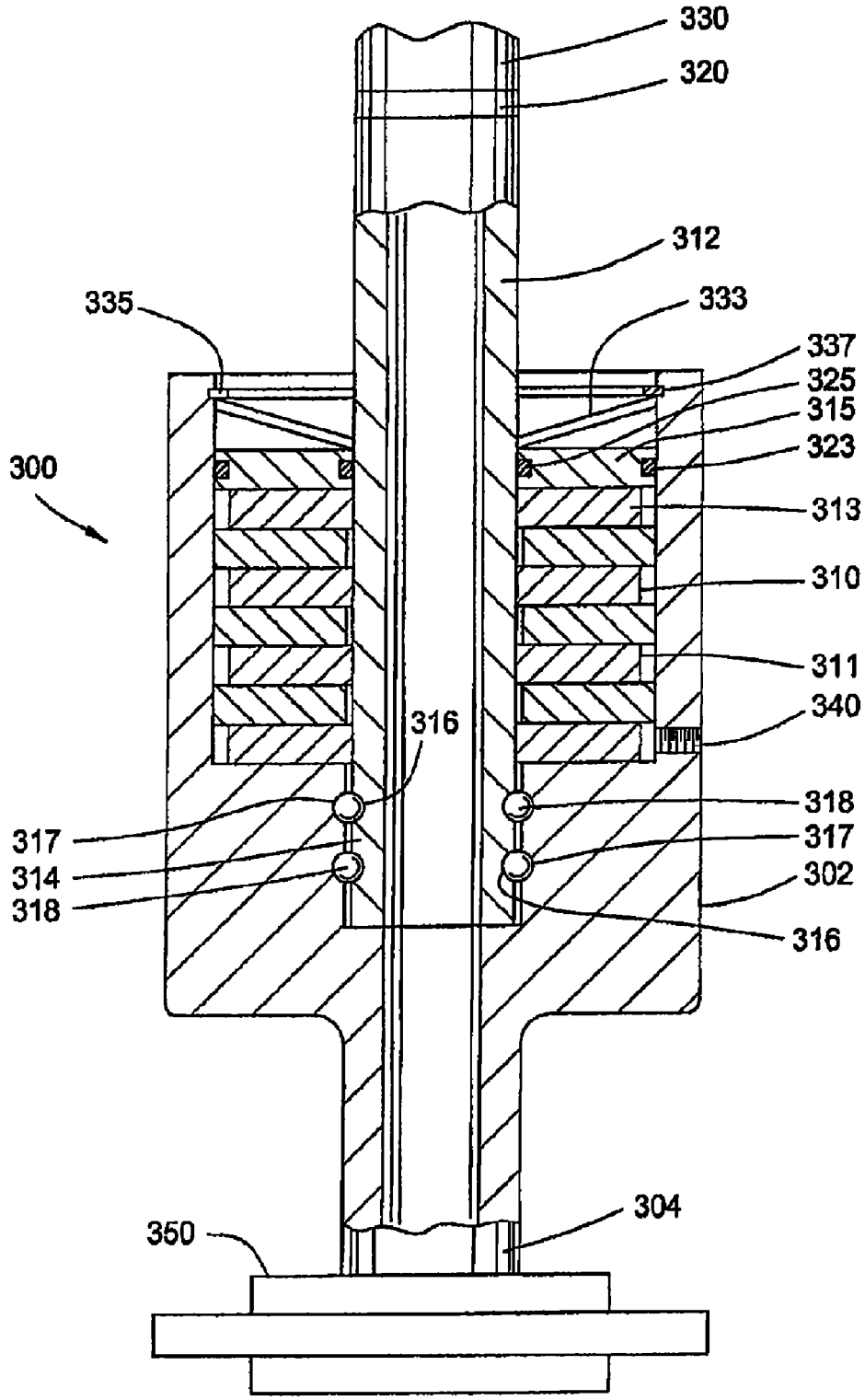
FIG. 18 is a side view in cross-section of a top drive casing 15 system coupler.

FIG. 18 shows a top drive coupler 300 according to the present invention with a body 302 that houses a clutch apparatus 310. The body 302 has a lower threaded end 304. An input shaft 312 has a lower end 314 with bearing recesses 316 for bearings 318 a portion of which also resides in the recesses 317 of the body 302.

The clutch apparatuses 310 has a plurality of spaced-apart clutch plates 311 connected to the housing 302 (e.g. with a splined connection) and a plurality of spaced-apart clutch plates 313 connected to the input shaft 312. In certain aspects one set or the other of the clutch plates is covered with friction material, e.g. but not limited to typical brake and clutch lining materials. A piston 315 with edge O-ring seals 323, 325 is sealingly disposed above the top most clutch plate 313 in the interior space defined by an outer surface of the shaft 312 and an inner surface of the body 302. A spring apparatus 333 urges the piston 315 down, energizing the clutch. A snap ring 335 with a portion in a recess 337 of the body 302 holds the spring apparatus 333 in place. In one aspect the apparatus 333 is one or more belleville springs. FIG. 18 shows schematically a coupling 320 connected to or formed integrally of the shaft 312 and a top drive 330 connected releasably to the coupling 320. The coupler 300 provides for the selective rotation of an item connected beneath it by the selective engagement of the clutch apparatus and may be used, e.g., with any top drive casing make-up system, including those according to the present invention. A coupler 300 may be used to selectively increase, reduce, or stop the transmission of torque from the top drive to the torque head and/or other top drive driven devices, e.g. but not limited, tubular torque transmission devices; milling apparatuses and systems; drilling apparatuses and systems; and/or external or internal tubular gripping devices. A coupler 300 may be used with a power swivel 350. Through a channel 340 is selectively provided fluid under pressure (e.g. from a typical rig system or from a rig joint make-up monitor system) to deenergize the apparatus 300, e.g., just prior to an indication of the shouldering of a joint. Alternatively, to effect deenergizing, the spring apparatus 333 is deleted and the channel 340 is placed so that fluid is applied on top of the piston (with some seal member above the plates).

The present invention, therefore, provides in certain, but not necessarily all embodiments, a torque head for gripping a tubular member (e.g. but not limited to casing that is part of a casing string), the torque head with a housing, and grip mechanism within the housing for selectively gripping a tubular member within the housing; such a torque head wherein the grip mechanism is able to grip the tubular member and exert both axial and torsional forces on the tubular member while it is gripped; and/or such a torque head with a top drive connected to the torque head.

Provided, therefore, in certain aspects, a torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable. Such a torque head may have one, some, any combination of, or all the following: wherein the die apparatus is movably upwardly as the portion of the tubular is engaged and downwardly as the portion of the tubular is disengaged; a bearing insert disposed between the die apparatus and the at least one jaw for facilitating movement of the die apparatus with respect to the at least one jaw; wherein the bearing insert is made from thermoplastic material or carbon-fiber reinforced resin compound; the die apparatus positioned in a recess in the at least one jaw, and a stop member secured to the at least one jaw with a portion thereof projecting into the recess of the at least one jaw for limiting movement of the die apparatus and for preventing escape of the die apparatus from the recess; releasable connection apparatus for releasably connecting the torque head to another item; the releasable connection apparatus including a top plate mounted to a top of the housing, a top barrel mounted to the top plate, and the top barrel mounted to the top plate with shear bolts shearable in response to a predetermined load for selective separation of the top barrel from the top plate; wherein there is spring apparatus between the top barrel and the top plate providing for limited axial movement of the top barrel with respect to the top plate; a piston-cylinder apparatus interconnected between the at least one jaw and the housing for selectively moving the at least one jaw into and out of engagement with the portion of the tubular member; guide apparatus connected to the at least one jaw for guiding movement of the at least one jaw fluid circulation apparatus for selectively continuously providing fluid to a tubular member gripped by the torque head; wherein the tubular member is connected to a tubular string extending downwardly from the torque head and the fluid circulation apparatus circulates fluid to the tubular string during operation of the torque head; at least one lower member secured at the bottom of the housing with an inclined portion for facilitating entry of a tubular member into the housing; wherein the at least one lower member is a plurality of spaced-apart lower members; and/or wherein the at least one jaw is a plurality of spaced-apart jaws.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, wherein the die apparatus is movably upwardly as the portion of the tubular is engaged and downwardly as the portion of the tubular is disengaged, a bearing insert disposed between each die apparatus and each jaw for facilitating movement of the die apparatus with respect to the jaw, and releasable connection apparatus for releasably connecting the torque head to another item. Such a torque head may have one, some, any combination of, or all the following: torque head may have a top drive releasably secured to and above it.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, and releasable connection apparatus for releasably connecting the torque head to another item; a top plate mounted to a top of the housing, a top barrel mounted to the top plate, and the top barrel mounted to the top plate with shear bolts shearable in response to a predetermined load for selective separation of the top barrel from the top plate; wherein there is spring apparatus between the top barrel and the top plate providing for limited axial movement of the top barrel with respect to the top plate; fluid circulation apparatus for selectively continuously providing fluid to a tubular member gripped by the torque head; and/or a top drive releasably secured to and above the torque head.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable; and such a top drive system including pipe handler apparatus disposed beneath the elevator apparatus.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item; and such a top drive system including pipe handler apparatus disposed beneath the elevator apparatus.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member; such a method including facilitating positioning of the first tubular member with pipe handling apparatus selectively engaging the first tubular member; such a method wherein the top drive is movably mounted in a rig and the spider is a flush mounted spider on a rig floor; such a method wherein the second tubular member is a top tubular of a tubular string extending down into earth; and/or such a method wherein the tubular members are casing.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted thereto, the die apparatus movable with respect to the at least one jaw so that relative movement of the tubular with respect to the torque head is possible to the extent that the die apparatus is movable, rotating the first tubular with the top drive to disconnect the first tubular from the second tubular.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item, and rotating the first tubular with the top drive to disconnect the first tubular from the second tubular.

The present invention, therefore, provides in certain, but not necessarily all embodiments, a coupler device for coupling a torquing device to an item to be rotated thereby, the coupler device with a body with a first end and a second end, a recess in the first end of the body, a shaft with a shaft first end and a shaft second end, at least part of the shaft within the recess of the body, a clutch apparatus in the recess of the body, and clutch energizing apparatus for energizing the clutch apparatus; clutch deenergizing apparatus for deenergizing the clutch apparatus; and/or such a coupler device with the clutch apparatus having a plurality of spaced-apart shaft clutch plates connected to the shaft and projecting out therefrom into the recess of the body, a plurality of spaced-apart body clutch plates connected to and projecting inwardly into the recess of the body, and the plurality of spaced-apart shaft clutch plates interleaved with the plurality of spaced-apart body clutch plates.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

The invention claimed is:

1. A system coupled to an output shaft of a top drive for handling a tubular, comprising:

a housing for supporting a gripping assembly; and a shaft member having a shoulder portion for supporting the housing, wherein the shoulder portion and the housing are axially movable relative to each other, and wherein the shaft member is coupled to the output shaft of the top drive.

2. The system of claim 1, wherein the shaft member is disposed through the housing such that the shoulder portion supports an inner surface of the housing to support the gripping assembly.

3. The system of claim 1, wherein the housing includes a top plate member, and wherein the shoulder portion supports an inner surface of the top plate member to support the gripping assembly while the shaft member extends through the top plate member.

4. The system of claim 1, wherein the shoulder portion is disposed in the housing and the shaft member extends through the housing, and further comprising a spring member disposed between the housing and the shoulder portion.

5. The system of claim 1, wherein the shoulder portion is disposed in the housing and the shaft member extends through the housing, and further comprising a flange member coupled to the shaft member, and at least one fastener member disposed through the flange member, the housing, and the shoulder portion.

6. The system of claim 5, further comprising at least one first spring member disposed between the shoulder portion and the housing, and at least one second spring member disposed between the flange member and the housing.

7. The system of claim 6, wherein the at least one first and second spring members are coupled to the at least one fastener member.

8. The system of claim 1, wherein the gripping assembly comprises at least one radially movable slip member disposed in the housing and operable to engage and transmit torque to the tubular.

9. The system of claim 1, wherein the shoulder portion is disposed in the housing and the shaft member extends through the housing, and further comprising a spring member configured to allow axial movement between the shoulder portion and the housing.

10. The system of claim 1, wherein the shaft member is disposed above the shoulder portion, and wherein the shoulder portion is disposed above the gripping assembly.

11. The system of claim 10, wherein the shoulder portion supports an inner surface of the housing such that a load on the gripping assembly is supported by the output shaft of the top drive.

12. A method of handling a tubular using a system coupled to an output shaft of a top drive, comprising:

engaging the tubular with a gripping assembly;

supporting a housing of the gripping assembly using a shoulder portion of a shaft member that is coupled to the output shaft of the top drive;

rotating the tubular with the gripping assembly using the top drive to thereby connect the tubular to a tubular string; and moving the housing relative to the shoulder portion.

13. The method of claim 12, further comprising compressing a spring member to allow axial movement between the housing and the shoulder portion.

14. The method of claim 12, further comprising radially moving a slip member of the gripping assembly that is disposed in the housing to engage the tubular.

15. The method of claim 12, further comprising forcing the housing to move in a downward direction relative to the shoulder portion.

16. The method of claim 12, further comprising moving the shoulder portion relative to the housing.

17. The method of claim 12, further comprising compressing a spring member that is disposed between the housing and a flange member that is coupled to the shaft member to allow axial movement between the housing and the shaft member.

18. The method of claim 12, wherein the shoulder portion is disposed in the housing and supports an inner surface of the housing while the shaft member extends through the housing for connection to the output shaft.

19. The method of claim 12, wherein the shaft member is disposed above the shoulder portion, and wherein the shoulder portion is disposed above the gripping assembly.

20. A system coupled to an output shaft of a top drive for handling a tubular, comprising:

a housing for supporting a gripping assembly;

a shaft member having a shoulder portion for supporting the housing, wherein the shoulder portion and the housing are axially movable relative to each other, wherein the shoulder portion is disposed in the housing and the shaft member extends through the housing;

a flange member coupled to the shaft member; and at least one fastener member disposed through the flange member, the housing, and the shoulder portion.

21. The system of claim 20, further comprising at least one first spring member disposed between the shoulder portion and the housing, and at least one second spring member disposed between the flange member and the housing.

22. The system of claim 21, wherein the at least one first and second spring members are coupled to the at least one fastener member.

23. A system coupled to an output shaft of a top drive for handling a tubular, comprising:

a housing for supporting a gripping assembly; and a shaft member having a shoulder portion for supporting the housing, wherein the shoulder portion and the housing are axially movable relative to each other, wherein the gripping assembly comprises at least one radially movable slip member disposed in the housing and operable to engage and transmit torque to the tubular.

* * * * *